US006063008A

United States Patent [19]

McBride et al.

[11] Patent Number: 6,063,008

[45] Date of Patent: May 16, 2000

[54] ELLIPTICAL MOTION EXERCISE APPARATUS

[75] Inventors: Robert W. McBride, Springfield, Mo.; Raymond F. Lippitt, Bethesda, Md.

[73] Assignee: Stamina Products Inc., Springfield, Mo.

[21] Appl. No.: 09/123,417

[22] Filed: Jul. 28, 1998

Related U.S. Application Data

[60] Provisional application No. 60/072,722, Jan. 27, 1998.

[51] Int. Cl.[7] ..... A63B 22/04

[52] U.S. Cl. ..... 482/52; 482/57

[58] Field of Search ..... 482/51, 52, 57, 482/70, 71, 62

[56] References Cited

U.S. PATENT DOCUMENTS

| | | | |
|---|---|---|---|
| D. 398,672 | 9/1998 | Sands et al. . | |
| D. 408,477 | 4/1999 | Arnold et al. . | |
| 5,584,784 | 12/1996 | Wu | 482/57 |
| 5,779,598 | 7/1998 | Lee | 482/51 |
| 5,823,914 | 10/1998 | Chen | 482/57 |
| 5,823,917 | 10/1998 | Chen | 482/57 |
| 5,830,112 | 11/1998 | Wang | 482/57 |
| 5,865,712 | 2/1999 | Chang . | |
| 5,879,271 | 3/1999 | Stearns et al. . | |
| 5,882,281 | 3/1999 | Stearns et al. . | |
| 5,888,175 | 3/1999 | Chang . | |
| 5,888,176 | 3/1999 | Kuo . | |
| 5,888,177 | 3/1999 | Lin . | |
| 5,893,820 | 4/1999 | Maresh et al. . | |
| 5,895,339 | 4/1999 | Maresh . | |
| 5,902,216 | 5/1999 | Lee . | |

*Primary Examiner*—Stephen R. Crow

*Attorney, Agent, or Firm*—Pillsbury Madison & Sutro LLP

[57] ABSTRACT

A manually powered elliptical motion exercise apparatus includes a floor-supported frame, a crank mechanism defining a first axis, and radially-extending crank arms. A pair of elongated pedals include foot-receiving platforms for supporting a user standing thereon and are coupled to the crank mechanism by crank coupling structures such that each crank coupling structure traverses a generally circular path about the first axis as the pedals are manually operated by a standing user. A pedal guide defines a second axis that is fixed with respect to the frame, and each pedal is constructed and arranged to be supported on the guide for pivoting movement with respect to the second axis and to accommodate a horizontal extent of movement imparted to the foot-receiving platforms by movement of the elongated pedals around the first axis so that the foot-receiving platforms traverse an elliptical path of motion simulating natural striding foot movements. The apparatus includes hand-grasping structure to be grasped by the hands of user standing on the foot-receiving platforms. The apparatus further includes a pedal movement resisting mechanism operatively connected with the crank axle and including a continuously moving member constructed and arranged to move in conjunction with the movement of the pedals and to be resisted in the movement thereof to establish the effort required by the user to effect user-generated movement of the pedals. A rotating mass is constructed and arranged to rotate in conjunction with manual operation of the pedals and to generate a rotational inertia to facilitate continuous, user-generated movement of the pedals.

16 Claims, 10 Drawing Sheets

ELLIPTICAL MOTION EXERCISE APPARATUS

This application claims the benefit of prior filed provisional application Ser. No. 60/072,722 filed Jan. 27, 1998.

FIELD AND BACKGROUND OF THE INVENTION

The present application is directed to an exercise apparatus on which a user's feet move in generally elliptical paths of motion as the apparatus is pedaled by the user.

Elliptical pedal exercisers have increased in popularity. These exercisers permit a user to stand on pedal mechanisms and drive the pedals in a manner similar to driving the pedals of a stationary bicycle or a stair climbing machine. As opposed to stationary bicycles and stair climbing machines, however, the pedals of an elliptical pedal exerciser do not traverse a circular path of motion or an oscillating up-and-down path of motion. The pedals of an elliptical pedal exerciser are coupled to a pedal movement mechanism which causes the pedals to move in generally elliptical paths of motion, simulating the striding foot movements of a person while running or walking.

A number of different exercise apparatuses having pedals which move in generally elliptical paths of motion are described in the prior art literature. For representative examples, see U.S. Pat. Nos. 4,786,050; 5,242,343; 5,279,529; 5,352,169; 5,518,473; 5,540,637; 5,549,526; and 5,562,574.

While many different types of elliptical exercise apparatus have been proposed, and many have been commercialized, the need exists for improvements in construction and design which result in an apparatus of relatively simple constructions with a minimum of moving parts and which provides smooth, repeatable movement and also provides a robust mechanism that can withstand prolonged and repeated use.

SUMMARY

It is an object of the present invention to provide an improved elliptical motion exercise apparatus on which a standing user can manually operate a pair of foot-engageable pedals which move in manner that simulates the natural striding foot movements of a person while running or walking. This object is achieved in accordance with the principles of the present invention by a manually powered elliptical motion exercise apparatus which comprises a frame, a crank mechanism, a pair of foot-engageable elongated pedals, a pedal guide, hand grasping structure, a pedal movement resisting mechanism, and a rotating mass.

More particularly, the frame is constructed and arranged to be supported on a generally horizontal support surface, and the crank mechanism is carried by the frame and includes a crank axle rotatably mounted on the frame for rotation about a generally horizontal first axis and a pair of crank arms coupled to the crank axle which extend in opposite radial directions from the crank axle.

Each of the pair of foot-engageable elongated pedals have a first end, a second end, and a foot-receiving platform disposed therebetween for supporting a user standing thereon with a generally upright posture. Each of the elongated pedals includes a crank coupling structure constructed and arranged to pivotally couple each elongated pedal to a different one of the crank arms to permit the elongated pedal to pivot about an axis that is generally parallel to, but radially offset from, the first axis, so that the crank coupling structure of the elongated pedal traverses a circular path about the first axis as the elongated pedals are manually operated by a standing user to rotate the crank axle. The circular path of the crank coupling structures of the elongated pedals imparts a predetermined horizontal extent of movement to the foot-receiving platforms of the pair of elongated pedals.

The pedal guide defines a second axis that is fixed with respect to the frame in parallel relation to the first axis. Each elongated pedal is constructed and arranged to be supported on the pedal guide for pivoting movement with respect to the second axis as the crank coupling structure traverses the circular path about the first is and to accommodate the horizontal extent of movement of the foot-receiving platform of each elongated pedal, thereby causing a portion of the foot-receiving platform of each elongated pedal to traverse a generally elliptical path of motion as the elongated pedals are manually operated by a standing user to simulate the striding foot movements of a person while running or walking.

The hand grasping structure is connected to the frame and is constructed and arranged to be grasped by the hands of a user standing with a generally upright posture on the foot-receiving platforms of the pair of elongated pedals.

The pedal movement resisting mechanism is operatively connected with the crank axle and includes a continuously movable member constructed and arranged to move in conjunction with rotation of the crank axle and to be resisted in the movement thereof to establish the effort required by the user to effect the user-generated movement of the elongated pedals.

The rotating mass is constructed and arranged to rotate in conjunction with rotation of the crank axle as the elongated pedals are manually operated by a user standing thereon with a generally upright posture and to generate a rotational inertia to facilitate continuous, user-generated movement of the elongated pedals.

In a preferred embodiment, the crank coupling structure of each elongated pedal is attached to the first end of the pedal and the foot-receiving platform is fixed with respect to the first and second ends of the elongated pedal. Moreover, the pedal guide preferably comprises a pair of guide bearings and guide bearing retaining structures. Each guide bearing is associated with a one of the pair of elongated pedals, is carried on the frame, and is constructed and arranged to be rotatable about the second axis. The guide bearing retaining structures are connected to a lower portion of each of the elongated pedals near the second end and each is constructed and arranged to receive the associated guide bearing and to maintain the elongated pedal in pedal-supporting proximity to the guide bearing. The guide bearing and the guide bearing retaining structure are constructed and arranged to permit each pedal to translate and pivot with respect to the fixed second axis as the crank coupling structure traverses the circular path about the first axis to accommodate the horizontal extent of movement of the foot-receiving platform of each elongated pedal, thereby causing the foot-receiving platform of each elongated pedal to traverse the generally elliptical path of motion as the elongated pedals are manually operated by a standing user to simulate the striding foot movements of a person while running or walking.

Also in a preferred embodiment, the continuously movable member of the pedal movement resisting structure comprises a flywheel, rotatably carried by the frame, in which the rotating mass is embodied. The resistance to the movement of the flywheel is preferably provided by a friction belt extending about an outer peripheral portion of the flywheel which resists rotation of the flywheel, and the manually operable resistance adjusting structure comprises a friction belt tension adjustment mechanism constructed and arranged to permit selective adjustment of tension in the friction belt to vary the frictional contact between the friction belt and the flywheel to thereby vary the effort required by the user to effect the user-generated movement of the elongated pedals at any given speed of movement. While the tensioned friction belt constitutes a preferred manner of resisting rotation of the flywheel, other known mechanisms for resisting rotation of the flywheel include magnetic brakes, fan blades, caliper brakes, disc brakes, or wheels pressed against the outer periphery of the flywheel with variable pressure.

The hand grasping structure may be fixedly connected to the frame, or it may mounted to the frame for movement, and, more particularly, for oscillating movement in conjunction with movement of the elongated pedals.

Other objects, features, and characteristics of the present invention will become apparent upon consideration of the following description and the appended claims with reference to the accompanying drawings, all of which form a part of the specification, and wherein like reference numerals designate corresponding parts in the various figures.

DESCRIPTION OF THE PREFERRED EMBODIMENT

Figure 1:
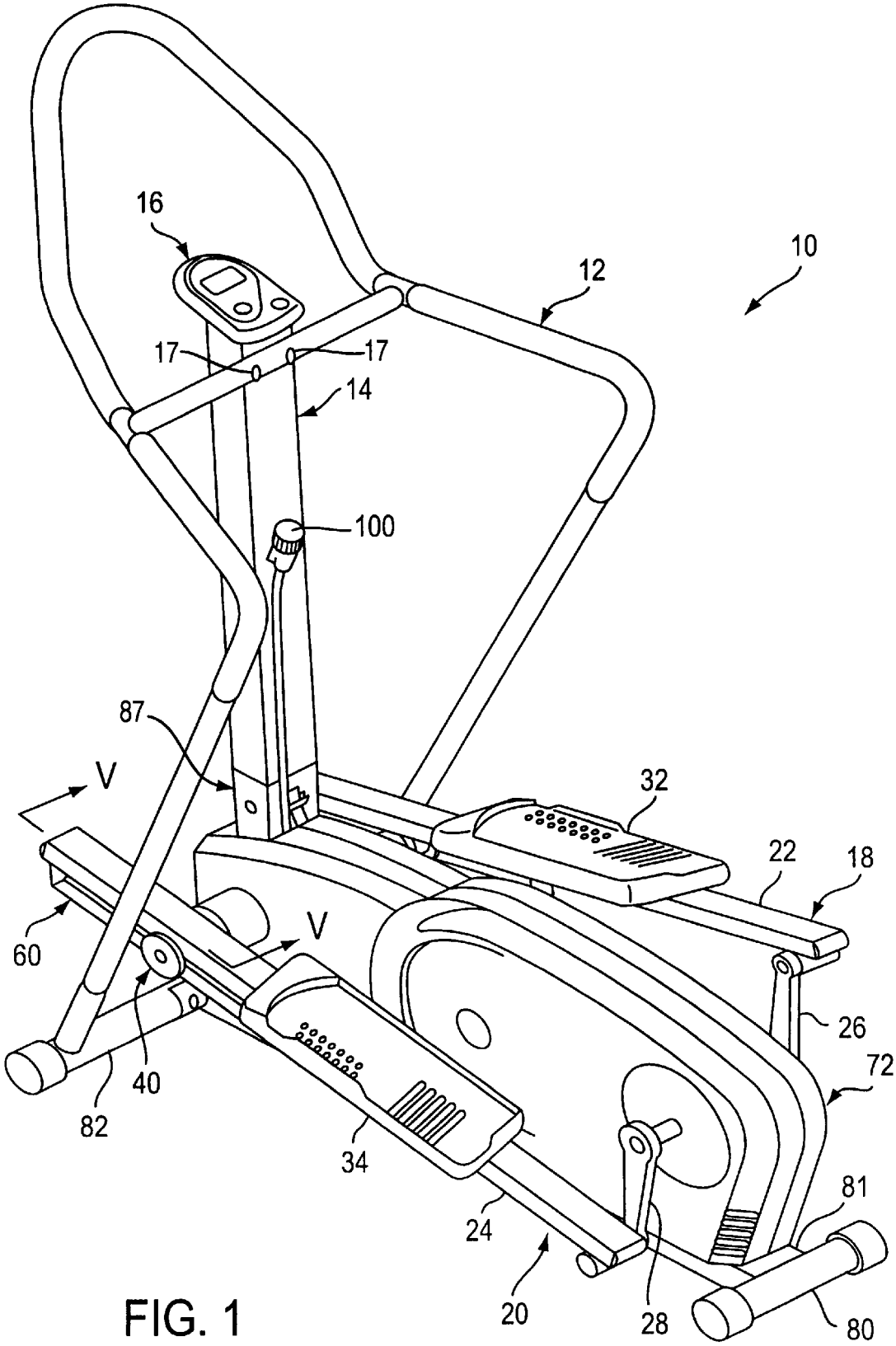
FIG. 1 is a perspective view of an elliptical motion exercise apparatus according to the present invention.
Figure 2:
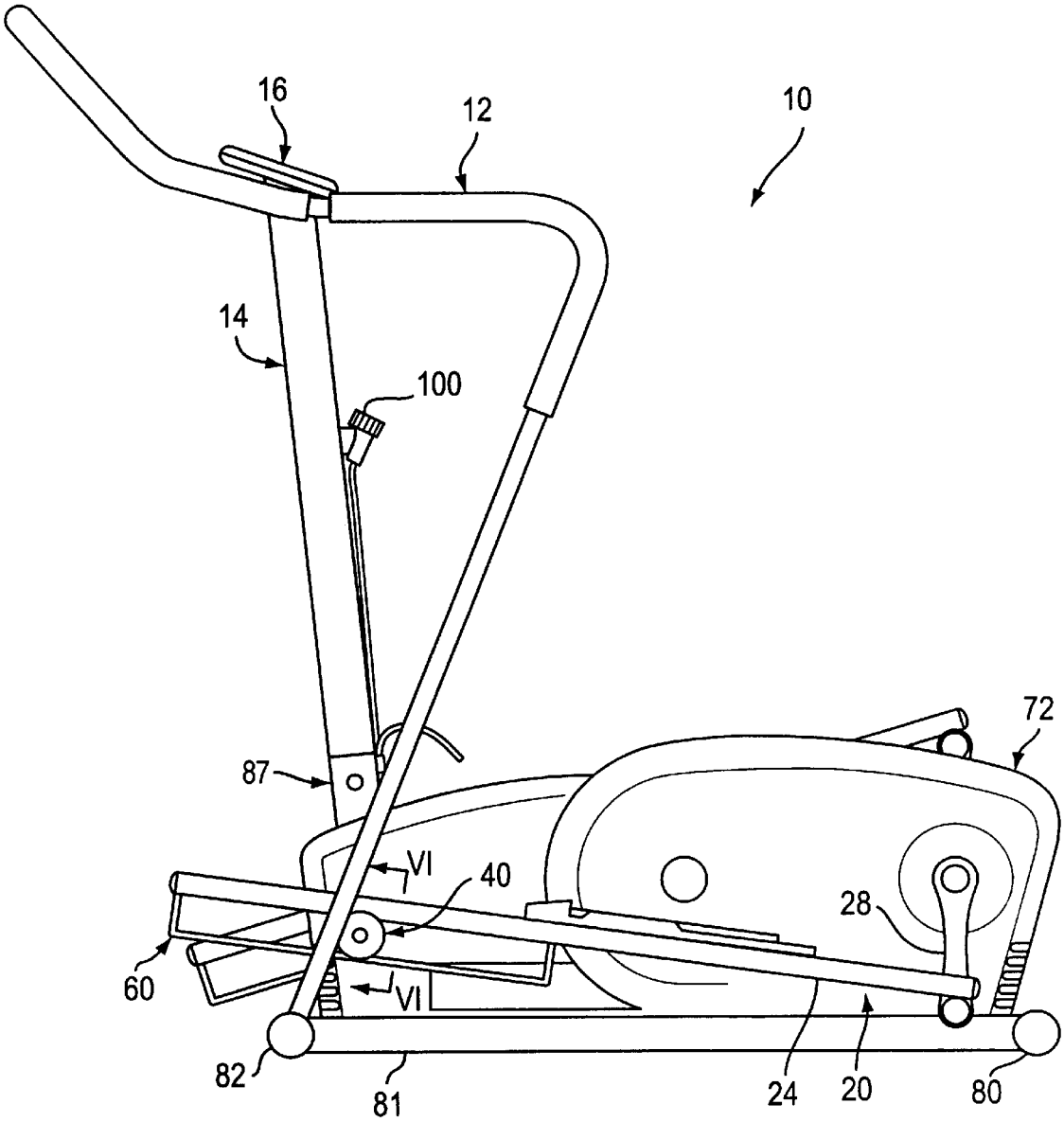
FIG. 2 is a side elevation of the elliptical motion exercise apparatus according to the present invention.

An elliptical motion exercise apparatus according to the present invention is generally designated by reference No. 10 in FIGS. 1 and 2. The apparatus 10 includes a main frame member 81. A front lateral stabilizer 82 and a rear lateral stabilizer 80 may be connected to opposite ends of the main frame member 81, such as by welding. A base post 87 extends upwardly from main frame member 81 at a slight forward angle from true vertical. A center control post 14 extends up to the handrail structure 12 and preferably has attached to the top end thereof an indicator device 16. Indicator device 16 may comprise a digital readout device which indicates revolutions, speed, distance, and/or time and may be coupled in a known manner to the moving components of the device so as to indicate revolutions, speed, and distance, or other relevant parameters. The apparatus 10 preferably also includes an upstanding hand rail structure generally designated by reference No. 12. Hand rail structure 12 extends up from the front lateral stabilizer 82 and is attached at an upper portion thereof to an upper portion of the center post 14 by fasteners 17.

A housing 72 covers internal structural and moving components of the apparatus 10.

Figure 3:
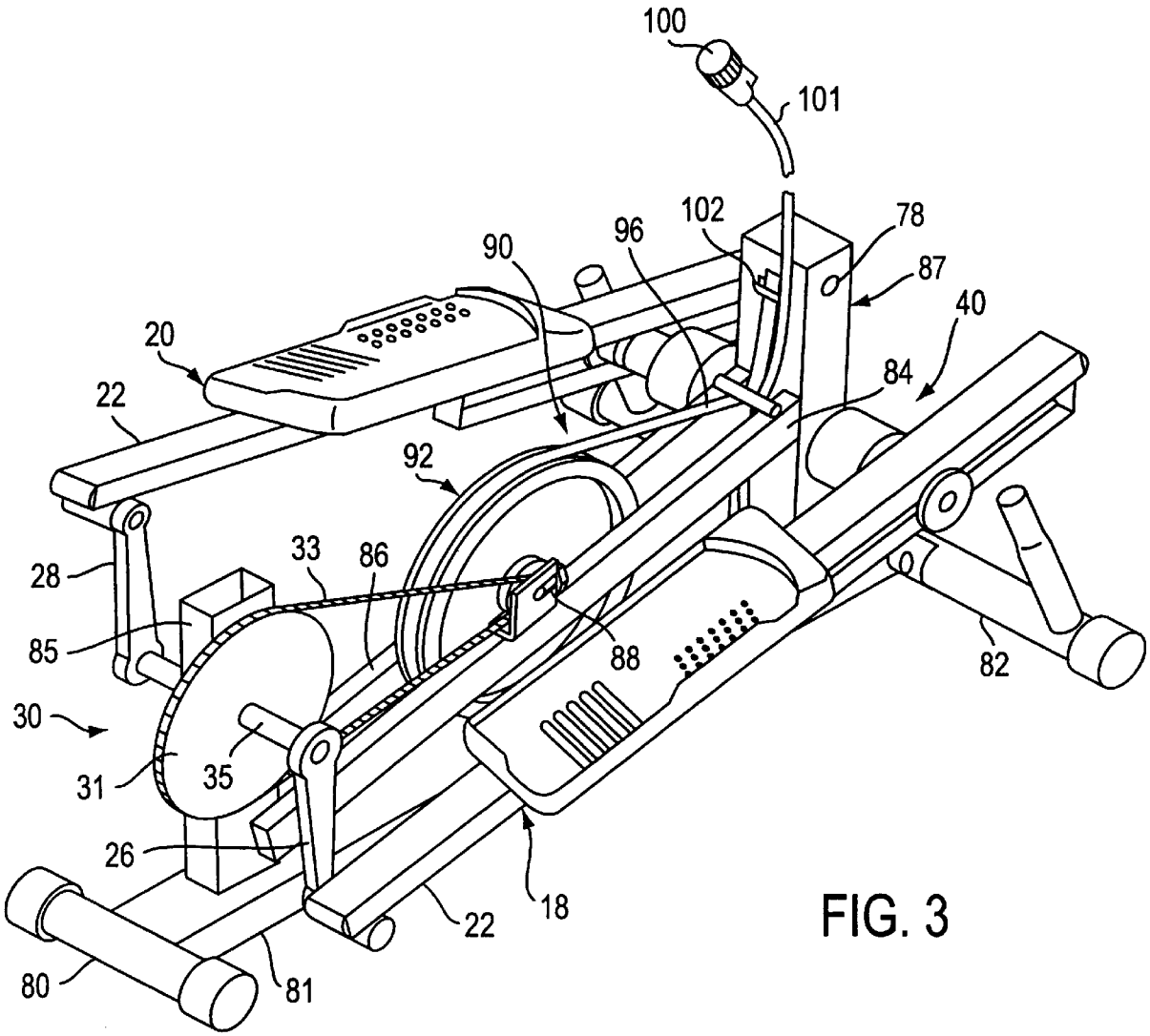
FIG. 3 is a partial perspective view of a crank assembly and a flywheel mechanism of the elliptical motion exercise apparatus of the present invention.

The apparatus 10 further includes right and left pedal assemblies 18, 20. As shown in FIG. 3 in which housing 72 is removed, the pedal assemblies are operatively connected at the respective rear ends thereof to a crank assembly 30. The pedal assemblies 18 and 20 are further operatively connected at the forward ends thereof to a pedal guide mechanism comprising left and right bearing assemblies 40 (only the left bearing assembly is visible in FIG. 1).

The apparatus is operated by a user standing on the left and right pedal assemblies 18, 20, facing the control post 14, and moving the pedal assemblies and the crank assembly 30 by a pedaling motion to thereby rotate the rear ends of the pedal assemblies 18, 20 about the crank assembly 30. The bearing assemblies 40 are constructed and arranged to permit the forward ends of the pedal assemblies 18, 20 to both translate and pivot with respect to the bearing assembly 40 as the rear ends of the pedal assemblies rotate about the crank assembly 30 so that the user's feet will travel in a generally elliptical path of motion.

Figure 7:
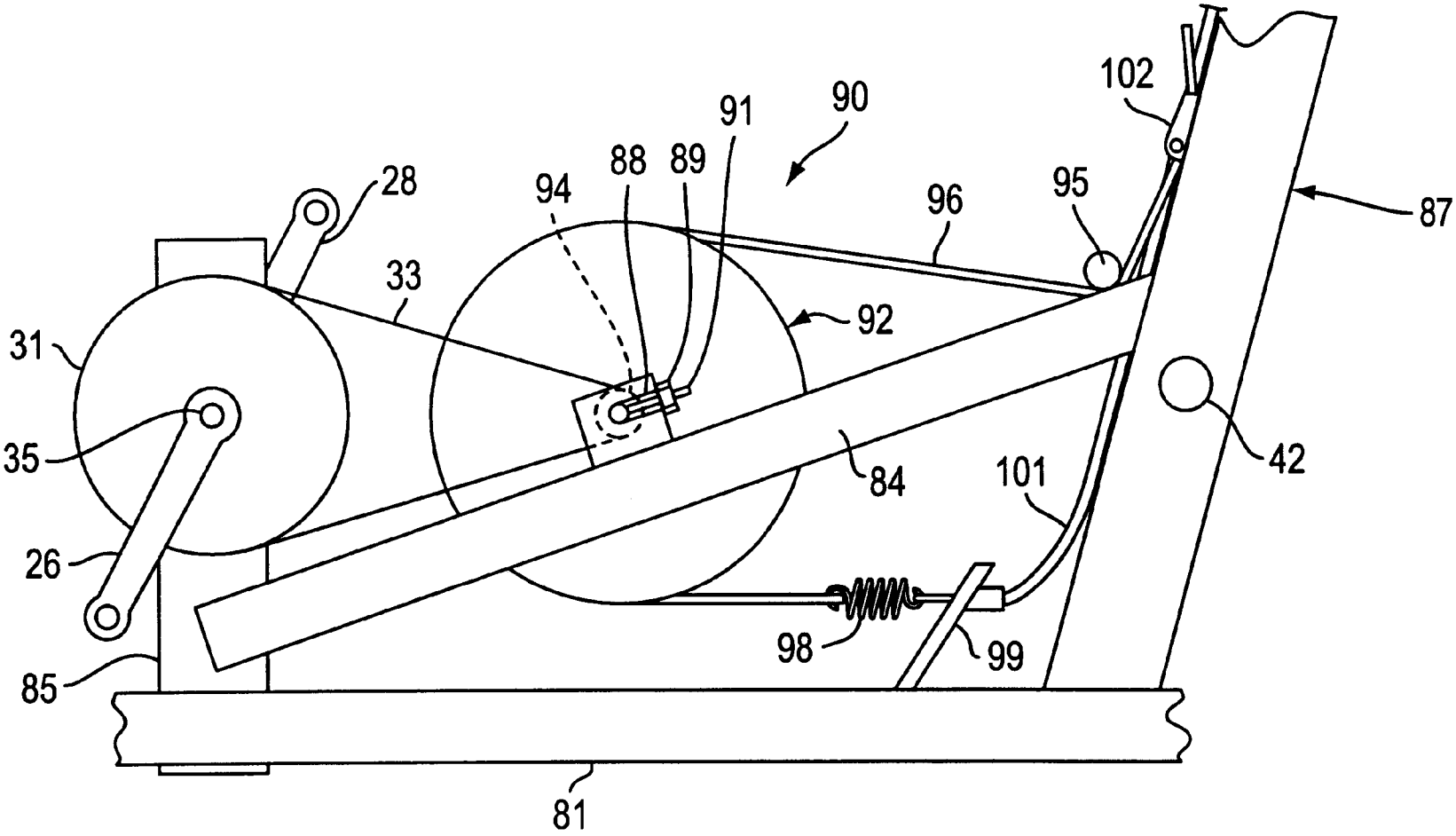
FIG. 7 is a partial side view of the crank assembly and flywheel mechanism of the elliptical motion exercise apparatus.

As shown in FIG. 3, longitudinal frame members 84 and 86 extend from the control post 14 rearwardly to a rear upstanding post 85 extending up from the main frame member 81. The frame members 84 and 86 are preferably arranged in a spaced apart arrangement so as to be parallel with one another. A flywheel assembly 90 is operatively disposed between the frame members 84 and 86. (see also FIG. 7) Flywheel assembly 90 includes a flywheel 92 rotatably mounted between the frame members 84 and 86 on a bracket having a longitudinally extending slot 88. A flywheel sprocket 94 is attached coaxially to the flywheel 92. A friction belt 96 extends about the outer periphery of the flywheel 92 and is anchored at a first end by a releasable clasp 102, passes under a guide rod 95, and is anchored at a second end to a spring 98. A belt tension adjust knob 100 is attached to the control post 14 and is connected by a cable 101 to the spring end 98 of the friction belt 96 mounted at an upwardly extending bracket 99. The tension adjust knob can be rotated one way or the other to either increase or decrease the tension in the belt 96 to either increase or decrease the rotational resistance applied to the flywheel 92. The belt 96 is preferably attached at the first end by the releasable clasp 102 so that the belt can be unclasped and gross tension adjustments can be manually made.

The crank assembly 30 comprises a crankshaft 35 extending laterally and rotationally mounted to upstanding post 85 of the frame. Right and left cranks 26, 28 are attached at opposite ends of the crankshaft 35 and extend in opposite radial directions. A sprocket 31 is fixed to the crankshaft 35, and a continuous chain 33 couples the sprocket 31 of the crank assembly 30 to the flywheel sprocket 94 of the flywheel assembly 90. Thus, it can be appreciated that operation of the crank assembly 30 with the pedal assemblies 18, 20 causes the flywheel 92 to rotate. The flywheel 92 provides sufficient rotational inertia to avoid the crank assembly 30 becoming stuck at dead center positions and further provides, via the friction belt 96, an adjustable resistance to the pedaling motion.

Preferably, flywheel 92 and attached flywheel sprocket 94 can be selectively moved and fixed along slot 88 by means of nut 89 coupled with threaded bolt 91 to adjust the tension in chain 33.

Figure 4:
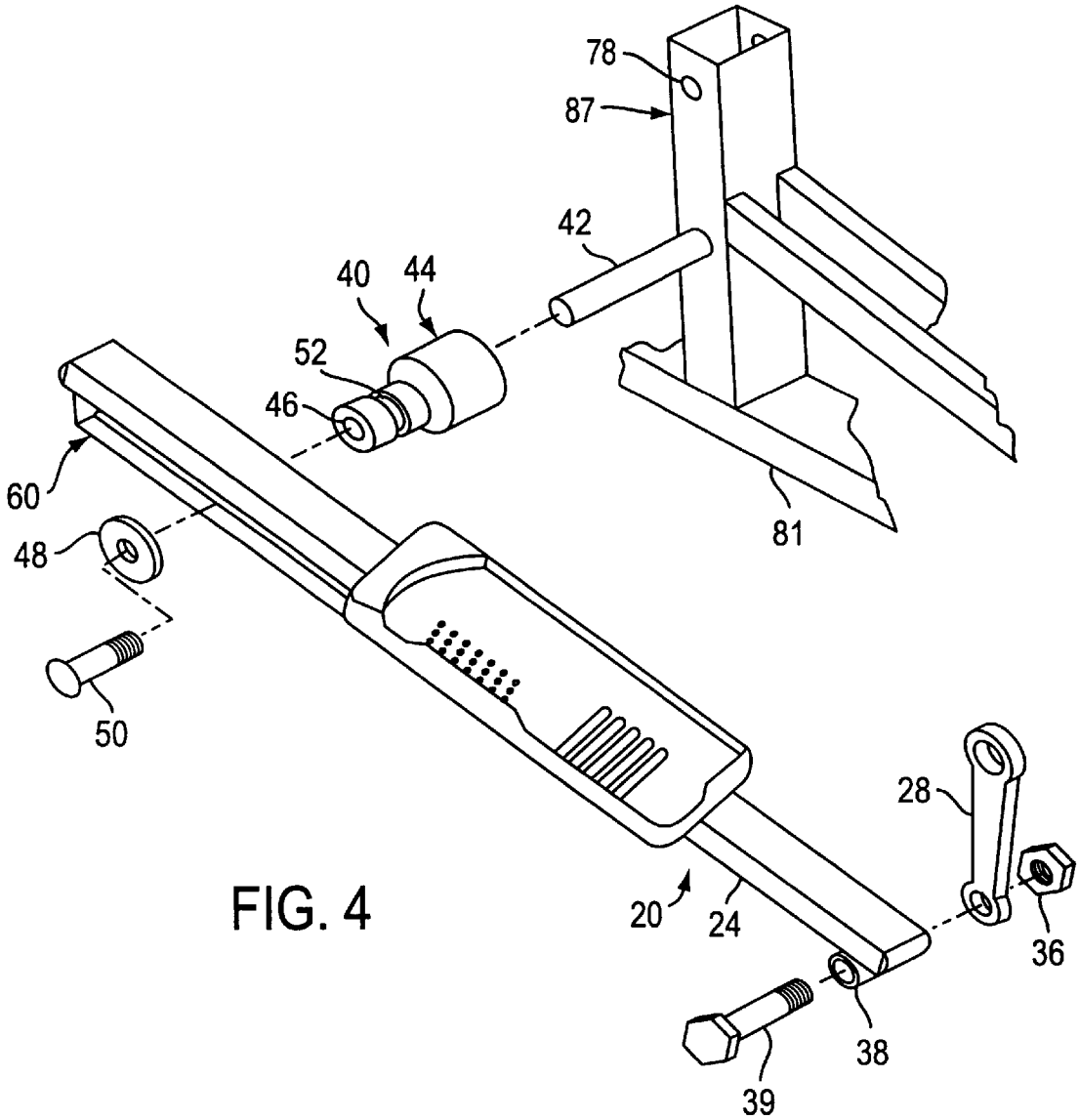
FIG. 4 is a partial, exploded perspective view of an elongated pedal and a pedal bearing assembly of the elliptical motion exercise apparatus of the present invention.

As shown in FIG. 4, the left pedal assembly 20 includes an elongated pedal 24. Elongated pedal 24 is attached to the crank 28 by means of a shaft bolt 39 extending through a journal connector structure 38 coupled to the underside of the elongated pedal 24 and through a threaded aperture at the end of the crank 28. Journal connector structure 38 is preferably attached to the elongated pedal 24 in a manner that allows the journal connector structure 38 to pivot about a generally vertical axis. This pivoting action of the journal connector structure 38 accommodates minor misalignments between the crank 28 and the shaft 35. A large flat plastic washer is preferably provided between the journal connector structure and the bottom of the elongated pedal 24. A thread-locking nut 36 prevents the shaft bolt 39 from becoming unthreaded from the crank 28 during use of the apparatus 10.

Right pedal assembly 18, having a right elongated pedal member 22, is similarly coupled to the right crank 26.

Both pedal assemblies 18, 20 preferably include foot pads 32, 34, respectively, attached to the respective elongated pedal members 22, 24.

Figure 5:
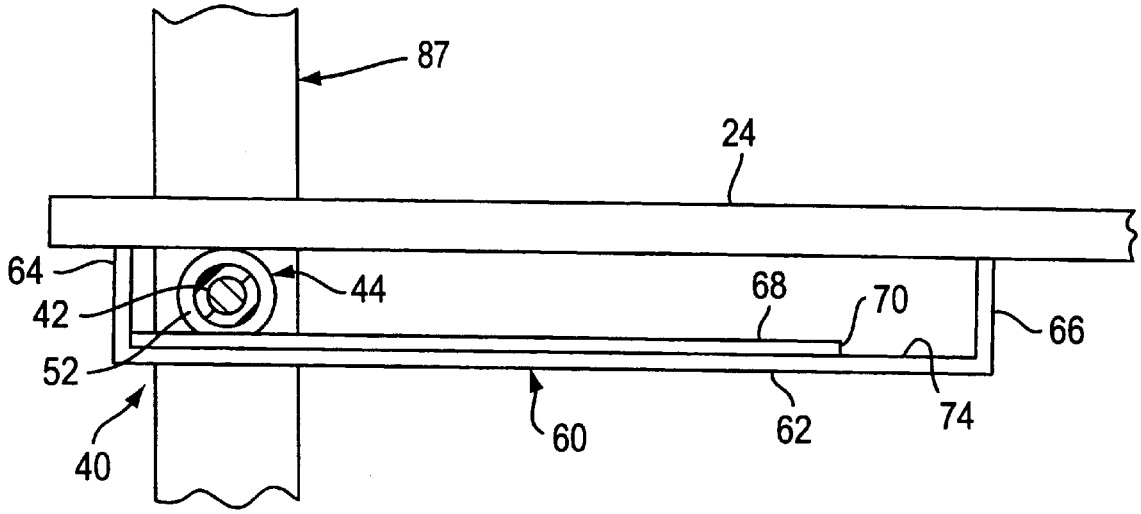
FIG. 5 is a partial view, partially in cross-section, of the pedal and the pedal bearing assembly viewed in the direction of line "V—V" in FIG. 1.
Figure 6:
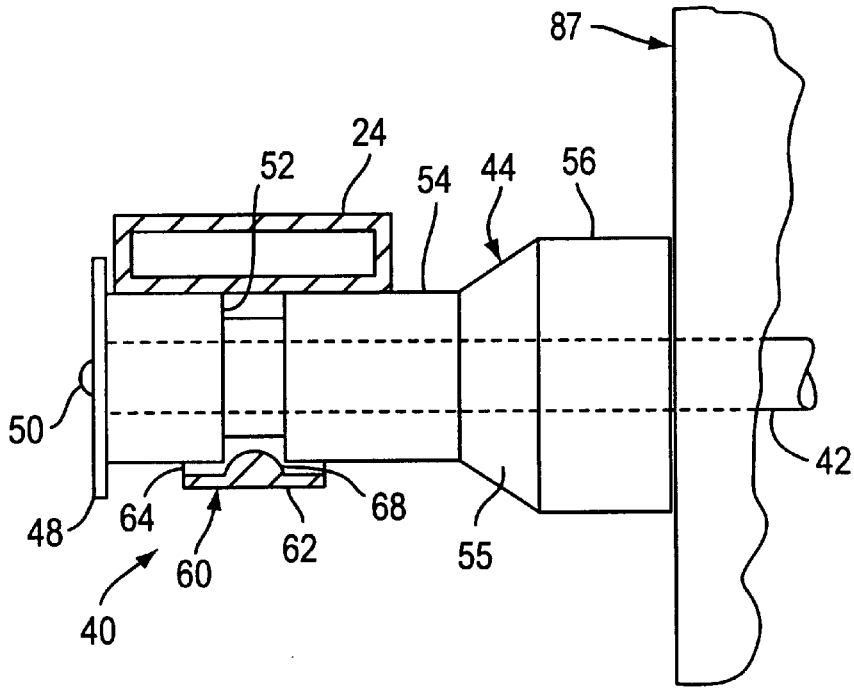
FIG. 6 is a partial view, partially in cross-section, of the pedal and pedal bearing assembly viewed in the direction of line "VI—VI" in FIG. 2.

As shown in FIGS. 4–6, the forward end of elongated pedal member 24 is rollably and slidably connected with the pedal bearing assembly 40. The pedal bearing assembly 40 comprises a lateral shaft 42 extending through the frame of the apparatus on opposite sides of the center line of the apparatus. A bearing 44, preferably in the form of a roller, has an axial hole 46 formed therethrough and is journally supported on the shaft 42. The bearing 44 preferably includes an outboard section 54, an inboard section 56 preferably, being of a larger diameter than outboard section 54, and a sloped transition region 55 between the outboard section 54 and the inboard section 56. A circumferential groove 52 is formed in the outboard section 54 of the bearing 44.

The bearing 44 is received within a bearing frame 60 comprising longitudinal portion 62 and vertical portions 64 and 66, being of generally the same length. A bearing ridge 68 is disposed along the center of the longitudinal portion 62 from the forward vertical portion 64 of the frame 60 back to the end 70 of the bearing ridge 68. When the bearing 44 is received within the bearing track frame 60, the bearing ridge 68 is generally disposed in the circumferential groove 52 of the bearing 44. Because of the bearing ridge 68 disposed in the groove 52, the elongated pedal member 24 is prevented from moving axially off of the bearing 44.

The pedal member 24 is installed onto the bearing 44 by sliding the frame 60 axially over the bearing 44 when the bearing 44 is disposed at the far rear end 74 of the frame 60, beyond the end 70 of the bearing ridge 68. The pedal 24 is then moved rearwardly and attached as described above at its rear end to the crank 28. A washer 48 is attached by means of a screw 50 to the end of the bearing shaft 42 to hold the bearing 44 onto the bearing shaft 42. The forward motion of the pedal 24 during movement of the rear end thereof about the crank assembly 30 is such that the bearing 44 will not move past the end 70 of the bearing ridge 68, so the pedal 24 will not come off the bearing 44 at the far rear end 74 of the frame 60.

Figure 8:
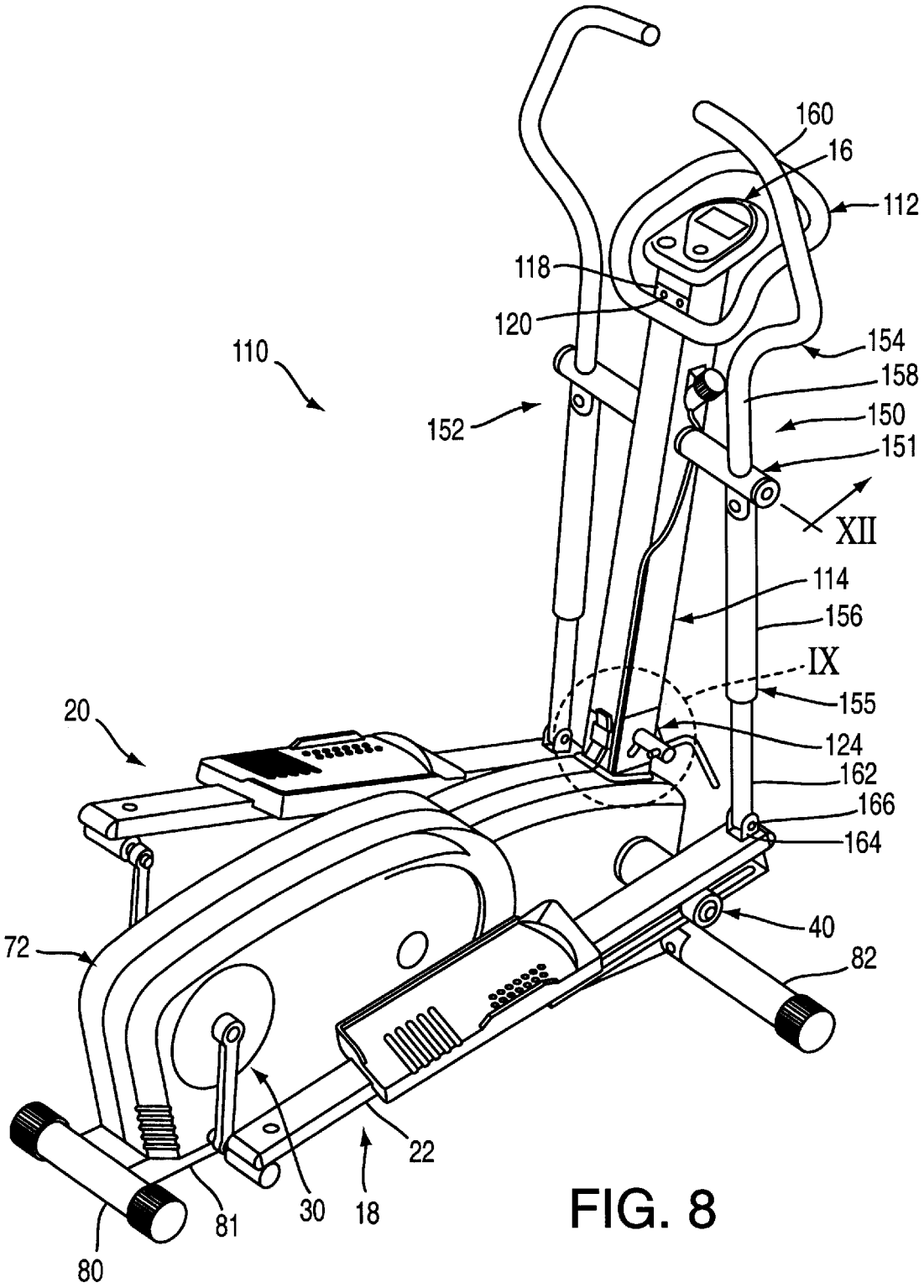
FIG. 8 is a perspective view of a second embodiment of an elliptical motion exercise apparatus according to the present invention.

A second embodiment of the elliptical motion exercise apparatus is designated generally by reference number 110 in FIG. 8. Apparatus 110 is in many structural and functional respects identical to the previously described embodiment 10 shown in FIG. 1. The apparatus 110 includes a main frame member 81 with front lateral stabilizer 82 and a rear lateral stabilizer 80 on which the remaining components of the apparatus are supported. A housing 72 covers internal moving components. In addition, right and left pedal assemblies 18, 20 are operatively supported at the rear ends thereof by a crank assembly 30 and at the front ends thereof by right and left bearing assemblies 40 (only the right bearing assembly is visible in FIG. 8) of the pedal guide mechanism.

The apparatus 110 differs from the apparatus 10 of the first embodiment in that apparatus 110 includes a pivoting center control post 114 and right and left oscillating arm lever assemblies 150 and 152, and further omits the upstanding handrail structure 12 of the apparatus 10 shown in FIG. 1.

The pivoting center control post 114 preferably has attached to the top end thereof an indicator device 16, such as that described above. A fixed handle assembly 112 is attached near the top of the center control post 114 and preferably comprises a continuous metal tube covered at the hand-ripping portions thereof by a foam padding. The fixed handle assembly 112 further includes a mounting flange 118 attached to the continuous metal tube by welding, and the fixed handle assembly 112 is attached to the center control post 114 by means of a pair of mounting fasteners 120 extending through apertures formed in the mounting flange 118 and a rear face of the center control post 114.

Figure 9:
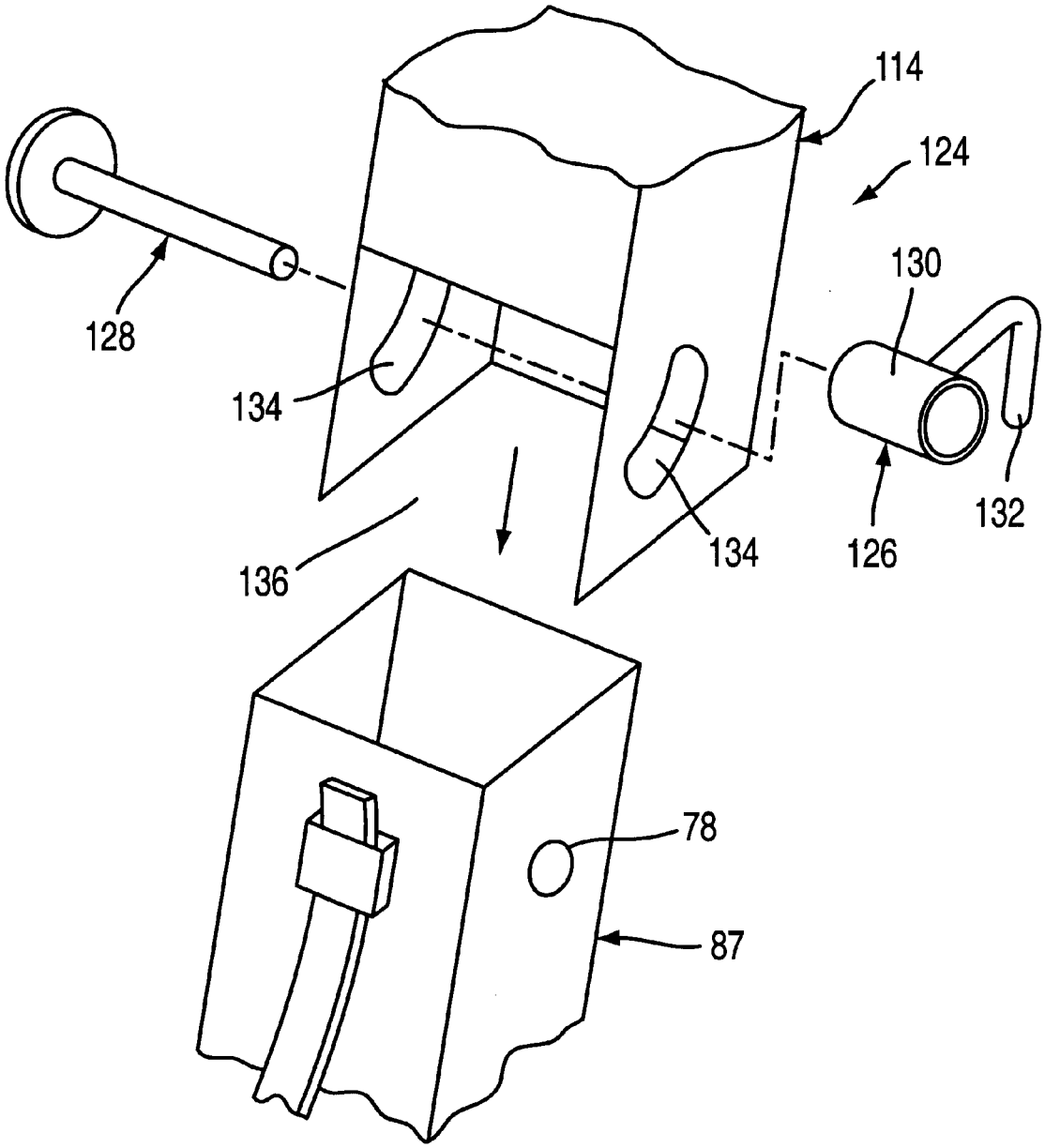
FIG. 9 is an enlarged exploded perspective view of the area within the circle "IX" in FIG. 8.
Figure 10:
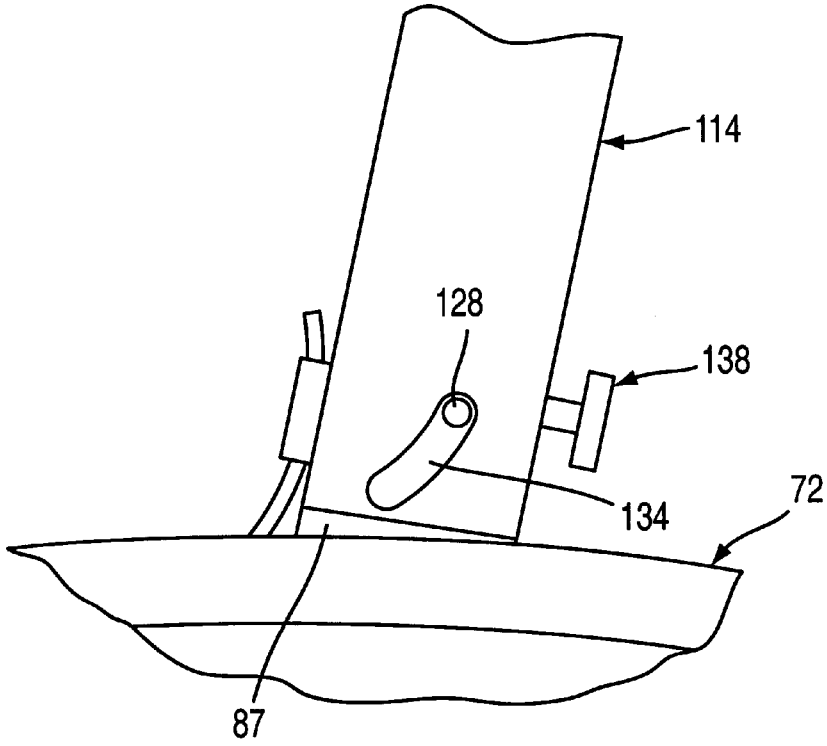
FIGS. 10 and 11 are enlarged side views of the area within the circle "IX" in FIG. 8 showing the pivoting center control post in the upright position and in the down position, respectively.
Figure 11:
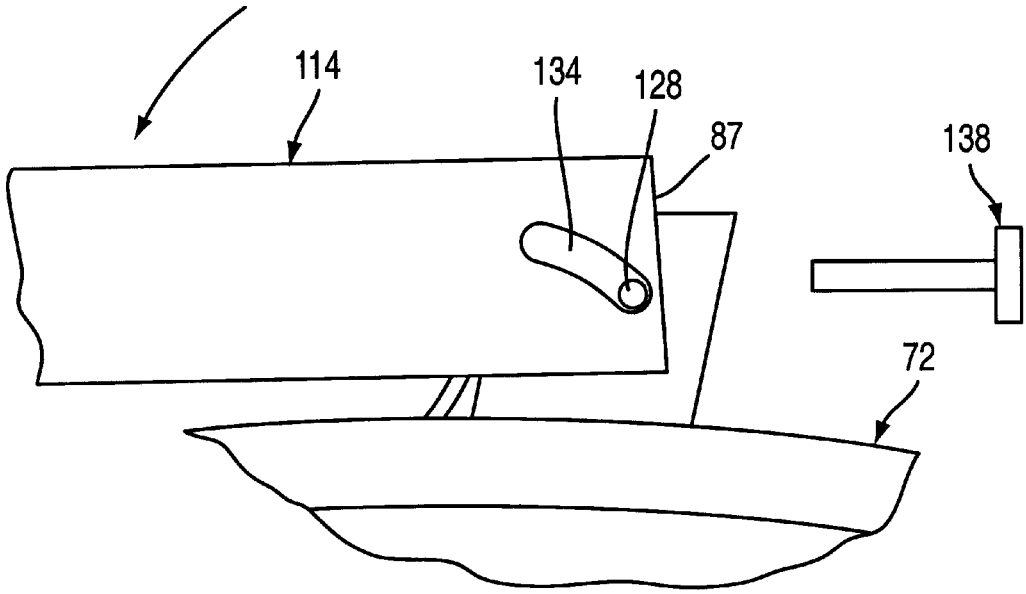

The lower end of the center control post 114 is mounted for selectively lockable pivoting movement by means of a pivotal mounting assembly 124 as best shown in FIGS. 9–11. In the preferred embodiment, the pivotal mounting assembly 124 is comprised of an open lower end of the pivoting center control post 114 which fits telescopically over the base post 87 extending from the main frame member 81 of the apparatus 110. An aperture 78 is formed transversely through opposed sides of the base post 87. When the pivoting center post 114 is inserted over the base post 87, aperture 78 is aligned with curved elongated apertures 134 formed in opposed sides of the center post 114.

A pin 128 extends through the curved elongated apertures 134 and the apertures 78 to provide pivoting attachment of the post 114 to the base post 87. An open section 136 at the lower back portion of the center post 114 and the curved elongated apertures 134 permit the center post 114 to rotate about the pin 128 between the upright, operative position shown in FIG. 10 and the lowered, stowed position shown in FIG. 11.

A quick-release attachment 126 receives a distal end of the pin 128. The quick-release attachment includes a lever 132 and a barrel 130 which receives and selectively grasps the end of the pin 128. The quick-release attachment 126 is similar to conventional quick-release attachments found on bicycle wheel assemblies and bicycle saddle post assemblies for permitting quick tightening and loosening of the assemblies with respect to a bicycle frame by the turning of a quick-release lever. Similarly, by rotating the lever 132 in a first direction, the barrel 130 of the quick-release attachment 126 grasps and locks onto the pin 128 and applies a fixed tension to the pin 128 to secure the center post 114 in a selected position. By rotating lever 132 in an opposite direction, the tension in the pin 128 is released, but the quick-release attachment 126 preferably remains attached to the pin 128. With the pin 128 released, the center post 114 is able to rotate.

To provide additional stability to the center post 114 when locked in its upright position as shown in FIG. 10, a knob with a threaded stud 138 is provided which extends through an aperture formed in the front of the center post 114 and through an aligned threaded aperture formed in the base post 87. The knob with the threaded stud 138 is removed from the center post 114 and base post 87 to permit rotation of the center post 114 as shown in FIG. 11.

The right arm lever assembly 150 and the left arm lever assembly 152 are identical in construction and, therefore, only the right arm lever assembly 150 will be described in detail.

The right arm lever assembly 150 includes an upper arm portion 154 and a lower arm portion 155 with a pivot assembly 151 disposed therebetween. The upper arm 154 includes an initial straight portion 158 extending above the pivot assembly 151 and a curved upper gripping portion 160. The lower arm 155 includes an upper telescoping portion 156 fixed at an upper end thereof proximate the pivoting assembly 151 and a lower telescoping portion 162. The bottom end of the lower telescoping portion 162 is pivotally attached to the front top portion of the elongated pedal member 22 of the right pedal assembly 18 by means of a transverse mounting pin 166 extending through a U-shaped mounting bracket 164 attached to the top of the pedal member 22 and an aperture formed in the lower end of the lower telescoping portion 162.

In the illustrated embodiment, the lower telescoping portion 162 fits within the upper telescoping portion 156. That is, lower portion 162 has an outside diameter that is smaller than the inside diameter of the upper telescoping portion 156. The telescoping portions could, however, be reversed without affecting the operation of the lower arm 155. That is, the lower arm 155 could be constructed and arranged so that the upper telescoping portion 156 could fit inside the lower telescoping portion 162.

Figure 12:
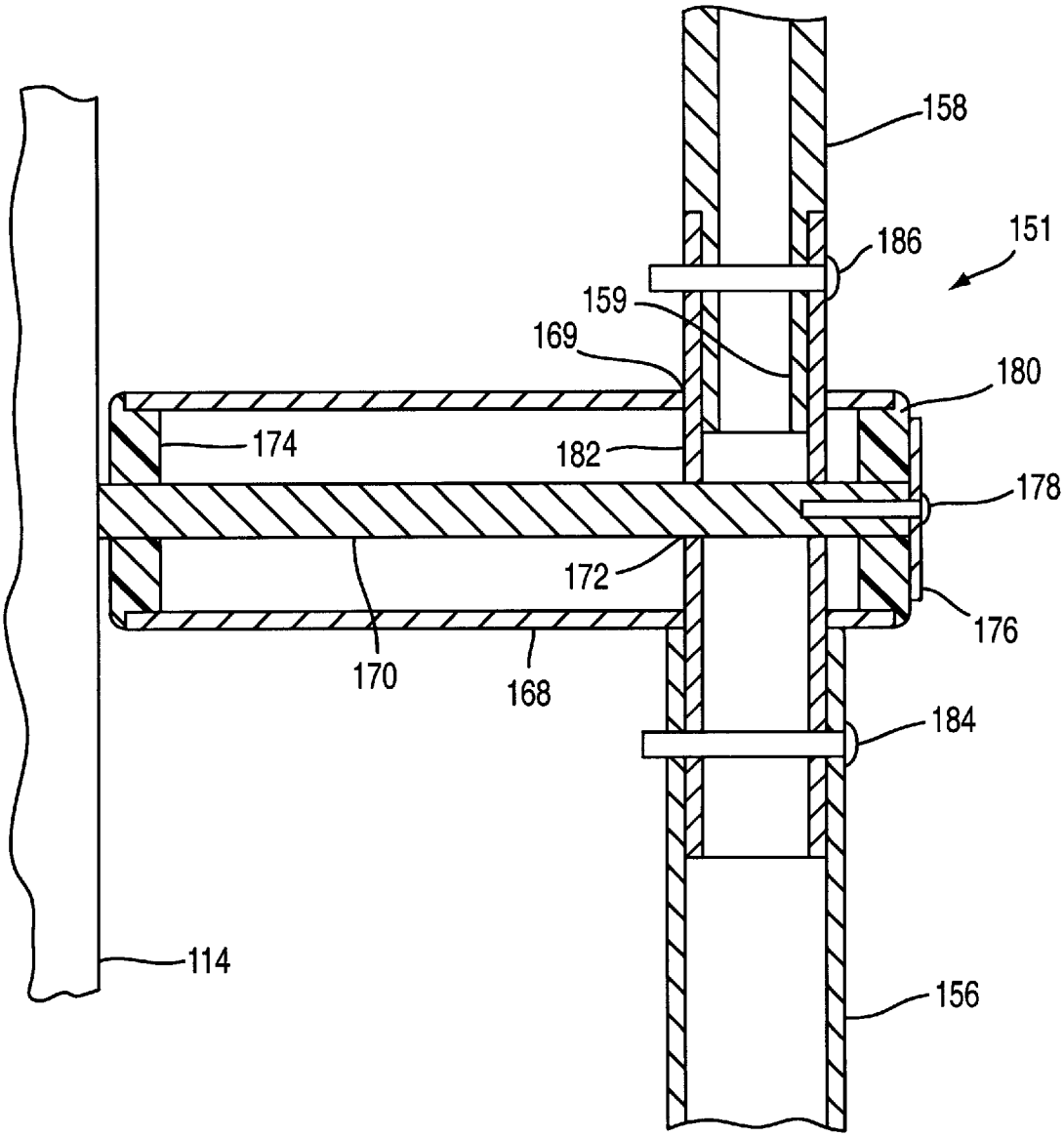
FIG. 12 is an enlarged partial sectional view taken in the direction "XII" in FIG. 8.

The details of the pivoting assembly 151 are shown in FIG. 12. A pivot rod 170 extends transversely through the center post 114. A spacer tube 168 having an inside end cap 174 and an outside end cap 180 fits coaxially over the pivot rod 170, and a connector tube 182 extends through a transverse through-hole 169 formed in the spacer tube 168. A transverse through-hole 172 formed in the connector tube 182 accommodates the pivot rod 170.

The spacer tube 168 and the connector tube 182 are assembled by first inserting the connector tube 182 through the transverse through-hole 169 and then inserting the spacer tube 168, with the end caps 174 and 180 being inserted into the ends thereof, over the pivot rod 170, so that the pivot rod 170 extends through the connector tube 182 and emerges at the outside end cap 180. A fastener 178 and washer 176 are secured to the end of the pivot rod 170 to secure the spacer tube 168 and connector tube 182 to the pivot rod 170.

The straight portion 158 of the upper arm 154 includes a narrow lower portion 159 which fits coaxially into an upper portion of the connector tube 182. A transverse fastener 186 may be inserted through aligned apertures formed in the lower portion 159 and the connector tube 182 to secure the upper arm 154 to the connector tube 182. An upper end of the upper telescoping portion 156 fits over a lower end of the connector tube 182 and may be secured in place by a fastener 184 extending transversely through aligned apertures formed in the upper telescoping portion 156 and the connector tube 182.

To operate the apparatus 110, the user stands with one foot on the foot pads 32, 34 of each of the pedal assemblies 18, 20 and drives the pedals so as to cause the crank assembly 30 to rotate. The user may optionally hold the fixed handle assembly 112 or grasp each of the lever arm assemblies 150, 152 to include an arm and upper body exercise motion with the pedaling exercise motion. As the rear ends of the pedal assemblies 18 and 22 traverse about the axis of the crank assembly 30, the forward ends of the pedal assemblies 18 and 22 move in a closed curve path as guided by the bearing guide assemblies 40. The fore and aft component of the motion of the forward ends of the pedal assemblies 18 and 20 causes the respective arm lever assemblies 150, 152, which are coupled thereto, to oscillate back and forth about the pivot axle 170 of the pivoting assembly 151. The vertical component of the motion of the forward ends of the pedal assemblies 18 and 22 is accommodated by the telescoping motion of the lower telescoping portion 162 with respect to the upper telescoping portion 156.

It will be realized that the foregoing preferred specific embodiment of the present invention has been shown and described for the purposes of illustrating the functional and structural principles of this invention and are subject to change without departure from such principles. Therefore, this invention includes all modifications encompassed within the spirit and scope of the following claims.

What is claimed is:

1. A manually powered elliptical motion exercise apparatus comprising:

a frame constructed and arranged to be supported on a generally horizontal support surface;

a crank mechanism carried by said frame and including a crank axle rotatably mounted on said frame for rotation about a generally horizontal first axis and a pair of crank arms coupled to said crank axle and extending in opposite radial directions from said crank axle;

a pair of foot-engageable elongated rigid pedals, each having a first end, a second end, and a foot-receiving platform disposed therebetween for supporting a user standing thereon with a generally upright posture, each of said elongated pedals including a crank coupling structure proximate said first end thereof and constructed and arranged to pivotally couple said first end of each elongated pedal to a different one of said crank arms to permit said elongated pedal to pivot about an axis that is generally parallel to, but radially offset from, said first axis, so that said crank coupling structure of said elongated pedal traverses a circular path about said first axis as said elongated pedals are manually operated by a standing user to rotate said crank axle, the circular path of the crank coupling structures of the elongated pedals imparting a predetermined horizontal extent of movement to said foot-receiving platforms of said pair of elongated pedals;

a pedal guide defining a second axis that is fixed with respect to said frame in parallel relation to said first axis, each elongated pedal being constructed and arranged to be supported on said pedal guide for pivoting movement with respect to said second axis as said crank coupling structure traverses the circular path about said first axis and to accommodate the horizontal extent of movement of said foot-receiving platform of each elongated pedal, thereby causing a portion of the foot-receiving platform of each elongated pedal to traverse a generally elliptical path of motion as the elongated pedals are manually operated by a standing user to simulate the striding foot movements of a person while running or walking, said pedal guide comprising a pair of guide bearings carried on said frame and constructed and arranged to be rotatable about said second axis, each guide bearing being associated with a one of said pair of elongated pedals and guide bearing retaining structures connected to a lower portion of each of said elongated pedals generally adjacent to said second end of said elongated pedal, wherein said guide bearing retaining structure of each elongated pedal is constructed and arranged to receive said associated guide bearing and to maintain said elongated pedal in pedal-supporting proximity to said guide bearing, and wherein said guide bearing and said guide bearing retaining structure are constructed and arranged to permit each pedal to translate and pivot with respect to said fixed second axis as said crank coupling structure traverses the circular path about said first axis to accommodate the horizontal extent of movement of said foot-receiving platform of each elongated pedal, thereby causing said foot-receiving platform of each elongated pedal to traverse the generally elliptical path of motion as the elongated pedals are manually operated by a standing user to simulate the striding foot movements of a person while running or walking;

hand grasping structure connected to said frame and constructed and arranged to be grasped by the hands of a user standing with a generally upright posture on said foot-receiving platforms of said pair of elongated pedals;

a pedal movement resisting mechanism operatively connected with said crank axle and including a continuously movable member constructed and arranged to move in conjunction with rotation of the crank axle and to be resisted in the movement thereof to establish the effort required by the user to effect the user-generated movement of the elongated pedals; and a rotating mass constructed and arranged to rotate in conjunction with rotation of the crank axle as said elongated pedals are manually operated by a user standing thereon with a generally upright posture and to generate a rotational inertia to facilitate continuous, user-generated movement of said elongated pedals.

2. The manually powered elliptical motion exercise apparatus of claim 1, wherein said rotating mass is embodied within said continuously movable member of said pedal movement resisting mechanism.

3. The manually powered elliptical motion exercise apparatus of claim 2, wherein said continuously movable member is rotatably carried by said frame for rotation about an axis parallel with said first axis and is drivingly connected with said crane axle to rotate at a faster speed than said crank axle during the user-generated movement of the elongated pedals.

4. The manually powered elliptical motion exercise apparatus of claim 3, wherein said pedal movement resisting mechanism includes manually operable resistance adjusting structure operatively associated with said continuously movable member and constructed and arranged to provide adjustable resistance to the movement of said continuously movable member to thereby vary the effort required by the user to effect the user-generated movement of the elongated pedals at any given speed of movement.

5. The manually powered elliptical motion exercise apparatus of claim 4, wherein said foot-receiving platforms of said elongated pedals are constructed and arranged to be fixed with respect to said first and second ends of said elongated pedals.

6. The manually powered elliptical motion exercise apparatus of claim 5, wherein said continuously movable member comprises a flywheel rotatably carried by said frame for rotation about an axis parallel to and offset from said first axis and a flywheel sprocket mounted coaxially to said flywheel and wherein said crank mechanism includes a drive sprocket mounted coaxially to said crank axle and having a larger diameter than said flywheel sprocket and a continuous chain drivingly coupling said drive sprocket to said flywheel sprocket.

7. The manually powered elliptical motion exercise apparatus of claim 6, wherein resistance to the movement of said flywheel is provided by a friction belt extending about an outer peripheral portion of said flywheel in frictional contact therewith to resist rotation of said flywheel to establish the effort required by the user to effect the user-generated movement of the elongated pedals.

8. The manually powered elliptical motion exercise apparatus of claim 7, wherein said manually operable resistance adjusting structure comprises a friction belt tension adjustment mechanism carried on said frame and coupled to said friction belt and constructed and arranged to permit selective adjustment of tension in said friction belt to vary the frictional contact between said friction belt and said flywheel to thereby vary the effort required by the user to effect the user-generated movement of the elongated pedals at any given speed of movement.

9. The manually powered elliptical motion exercise apparatus of claim 8, wherein said hand grasping structure is fixedly connected to said frame.

10. The manually powered elliptical motion exercise apparatus of claim 9, further including a center post mounted at a lower end thereof to said frame and extending upwardly from said frame, wherein said hand-grasping structure comprises a fixed hand rail connected at a lower end thereof to said frame and connected at an upper end thereof to an upper end of said center post.

11. The manually powered elliptical motion exercise apparatus of claim 1, further including a center post mounted at a lower end thereof to said frame and extending upwardly from said frame, wherein said hand-grasping structure is mounted at a portion thereof to an upper end of said center post.

12. The manually powered elliptical motion exercise apparatus of claim 1, wherein said pedal guide further includes a guide groove formed on a one of said guide bearing and said associated guide bearing retaining structure, and a guide ridge formed on the other of said guide bearing and said associated guide bearing retaining structure, said guide ridge being disposed within said guide groove to limit axial movement of said guide bearing retaining structure and said elongated pedal with respect to said second axis.

13. The manually powered elliptical motion exercise apparatus of claim 12, wherein said pedal guide includes a fixed shaft carried by said frame and having a longitudinal axis defining said second axis, and wherein said guide bearing comprises a roller rotatably mounted on said fixed shaft and having a cylindrical pedal-bearing portion, a portion of said elongated pedal being supported on said cylindrical pedal-bearing portion of said roller.

14. The manually powered elliptical motion exercise apparatus of claim 13, wherein said guide groove comprises a groove formed about the circumference of said cylindrical pedal-bearing portion of said roller and said guide ridge is formed on said guide bearing retaining structure.

15. The manually powered elliptical motion exercise apparatus of claim 14, wherein said guide bearing retaining structure comprises a frame attached to an underside of said elongated pedal, and including a front and a rear end segment extending down from the underside of said elongated pedal, and a longitudinal segment arranged to be generally parallel with the underside of said elongated pedal and spanning across and attached to said front and rear end segments, said guide ridge being formed on a top surface of said longitudinal segment facing the underside of said elongated pedal.

16. The manually powered elliptical motion exercise apparatus of claim 15, wherein said guide ridge extends along said longitudinal segment from said front end segment to a position spaced from said rear end segment, to permit said roller to be moved laterally into said guide frame at a rear portion of said guide frame where said guide ridge is absent from said longitudinal segment.

* * * * *